US005725469A

United States Patent [19]

Rehkemper et al.

[11] Patent Number: 5,725,469

[45] Date of Patent: Mar. 10, 1998

[54] TOY FOR DECORATING ARTICLES

[76] Inventors: Jeffrey G. Rehkemper, 1636 N. Wells, Chicago, Ill. 60614; Steven Rehkemper, 1030 N. State St., Chicago, Ill. 60610

[21] Appl. No.: 600,247

[22] Filed: Feb. 12, 1996

[51] Int. Cl.[6] ..... B31B 3/44; B31B 3/88

[52] U.S. Cl. ..... 493/167; 493/174; 493/959

[58] Field of Search ..... 493/167, 174, 493/175, 176, 177, 178, 185, 955, 956, 957, 958, 959, 940, 941, 154

[56] References Cited

U.S. PATENT DOCUMENTS

| | | | |
|---|---|---|---|
| 1,547,953 | 7/1925 | Palmer . | |
| 4,121,402 | 10/1978 | Cress . | |
| 4,493,437 | 1/1985 | Breeden . | |
| 4,522,618 | 6/1985 | Stannard | 493/174 |
| 4,637,811 | 1/1987 | Fortney | 493/167 |
| 5,073,161 | 12/1991 | Weder | 493/167 |
| 5,123,888 | 6/1992 | Fainberg | 493/167 |
| 5,269,741 | 12/1993 | Fischer | 493/167 |
| 5,350,349 | 9/1994 | Weder | 493/167 |
| 5,437,396 | 8/1995 | Russillo . | |
| 5,496,250 | 3/1996 | Fielder | 493/169 |

*Primary Examiner*—Joseph J. Hail, III
*Assistant Examiner*—Christopher W. Day
*Attorney, Agent, or Firm*—Jack Shore; Hamman and Benn

[57] ABSTRACT

A tool for providing cup-shaped, three-dimensional ornamentations for various items, such as, pictures, jewelry, or three-dimensional objects. The various tool embodiments include a power- or manually-driven plunger that engages a section of deformable material and drives it through a tapered nozzle opening to form a funnel-shaped cup. The bottom of the cup is adhered to an adhesive surface in a preselected pattern to provide the desired ornamentation.

4 Claims, 2 Drawing Sheets

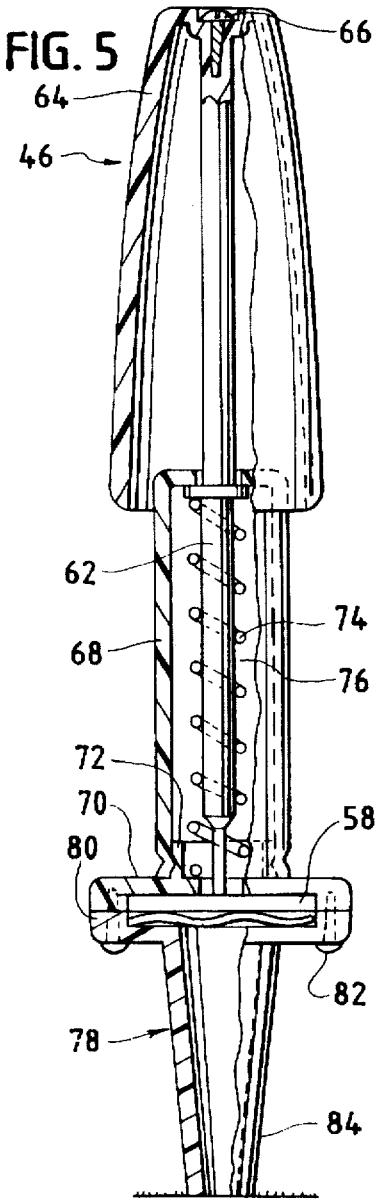
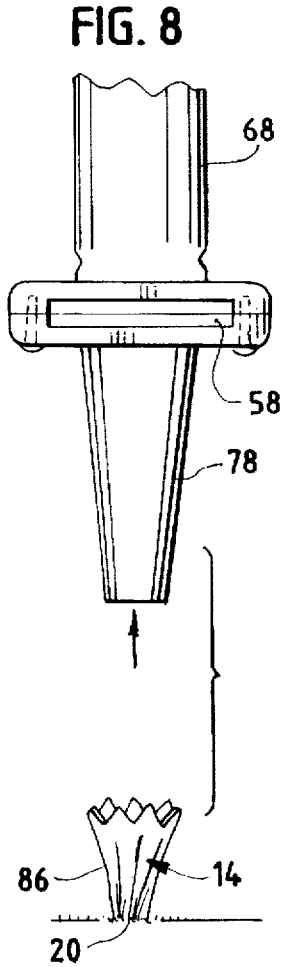
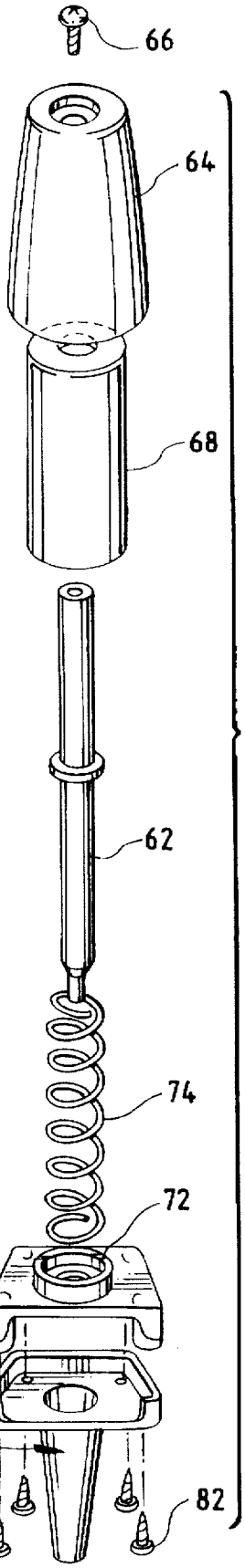
FIG. 9
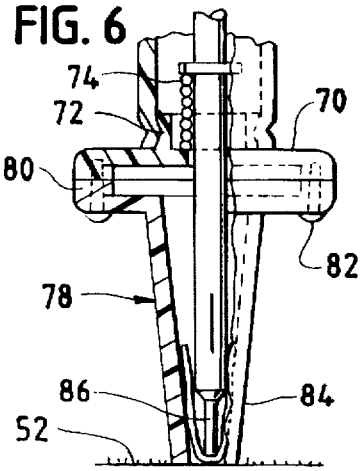
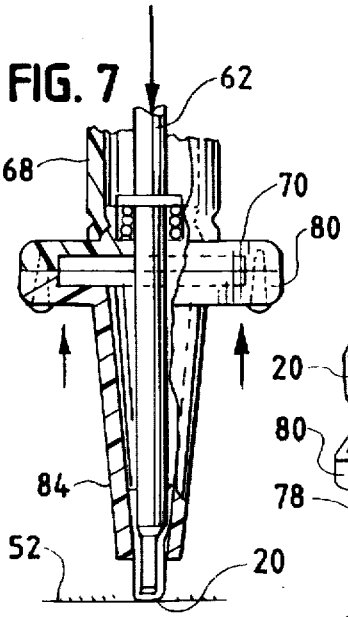

TOY FOR DECORATING ARTICLES

FIELD OF THE INVENTION

This invention relates to toys and particularly to such toys that can be operated to decorate articles such as pictures, jewelry, or three-dimensional objects by applying ornamentation thereto.

BACKGROUND OF THE INVENTION

Educational toys allowing children to exercise their creativity by forming a variety of objects have long been desired by parents. Toys of this type have been generally available and there has been a continuous effort to provide even more such toys if they are kept simple and easy to operate. The provision of a hand-operated tool or a relatively simple automatic device for decorating various items such as jewelry, pictures, or three-dimensional objects has long been desired, since they would be easy to operate and could be done so without potential harm to the user. One such type of toy that would be expected to receive wide acceptance would be one that could be used to secure ornamentation to a picture to form a desired three-dimensional pattern. Such ornamentation could take the form of a plurality of fluffy type structures surrounding a particular pictorial representation that would make for a very attractive ornamentation. Such a toy would permit the creativity of the child to form whatever type of design desired or to enhance an existing picture such as giving texture to a dog or other animal or any of a variety of scenic designs. The textured effect gives a very attractive three-dimensional perspective to the item which heretofore had been merely a flat drawing on a sheet of paper. To be able to accomplish this by a hand-operated tool, or if desired by automatic equipment such as a gun-type arrangement or an electrically operated tool, has long been desired by the tom industry since toys that enhance the creativity of the child find great acceptance in the toy field. Parents find that toys that can be hand-manipulated provide no danger to the child, yet allow the child to work in a quiet fashion to frame a picture or jewelry, etc., for which the child can be proud is a very desirable type of toy and parents are constantly on the lookout for such a toy.

SUMMARY OF THE INVENTION

In accordance with the present invention, there are provided various embodiments of toys that can take pieces of tissue or similar deformable paper, foil, or acetate, etc., and form them into fluffy or wrinkled funnel-shaped arrangements having a bottom, which bottom is subsequently adhered to a sticky surface in an ornamental arrangement. A typical type of sticky surface that is employed utilizes a two-layered sheet on which a drawing is made that is to be embellished by subsequent ornamentation. The two layers include release paper that is die cut to facilitate the release paper being taken off in selected areas to form a particular pattern. When the release paper is removed it exposes an adhesive surface against which the funnel-shaped cup arrangements can be adhered and where it will provide the desired three-dimensional effect. As aforementioned, various embodiments include the utilization of a row of tissue paper and a plunger which will act when activated in much the same way as a stapling gun to remove a portion of the tissue from the row and force it through a nozzle into a wrinkled funnel-shaped cup arrangement, the bottom of which will be directed onto an adhesive surface. The tool is then removed leaving the funnel-shaped cups adhered to the adhesive surface. This will be repeated to place the funnel-shaped cup arrangements to form any desired pattern on the sheet of paper or other object to which it is to be secured. While one form of ornamentation to be employed is for pictorial representations, it can be done to embellish other items, such as jewelry or other articles, where an adhereable surface is provided.

In another embodiment of the invention, there can be employed a "sewing machine-type" of toy wherein the machine is fixed in position and the adhereable sections of a paper are moved around to be directed below the nozzle from which the funnel-shaped cup is ejected. Thus, by moving a piece of paper around in very much the way a sewing machine is used, the funnel-shaped cup arrangements can be placed on the paper to provide various ornamental designs.

In the preferred embodiment, there is illustrated a manually operated tool that is essentially pen-shaped which includes a handle that can be movable to drive a punch into engagement with a disk or other configuration of tissue, or other deformable material, and drive the material down through the nozzle where it will contact the adhesive portion of a sheet upon which the funnel-shaped cup is to be located. In this arrangement, the handle and attached plunger is moved against the action of a spring to contact the paper and move the base of the cup into contact with the adhesive sheet. Upon release of the handle, the spring will return the handle and plunger to their normal position and the tool withdrawn from the sheet leaving the funnel-shaped cup arrangement on the sheet. The operator will then move the tool to another location on the sheet and sequentially place another cup-shaped arrangement in the desired location.

BRIEF DESCRIPTION OF THE DRAWINGS

FIG. 5 is a cross-sectional view of a manually operated tool;

FIG. 6 is a view similar to the bottom portion of FIG. 5 showing the plunger in the cup formation position;

FIG. 7 is a view similar to FIG. 6 illustrating the tool being removed from the sheet;

FIG. 8 is a pictorial view of the bottom portion of the tool removed from but leaving in place the adhered the cup-shaped funnel-shaped cup member; and FIG. 9 is an exploded view showing the various components of the tool in FIG. 5.

DESCRIPTION OF THE VARIOUS EMBODIMENTS

Figure 1:
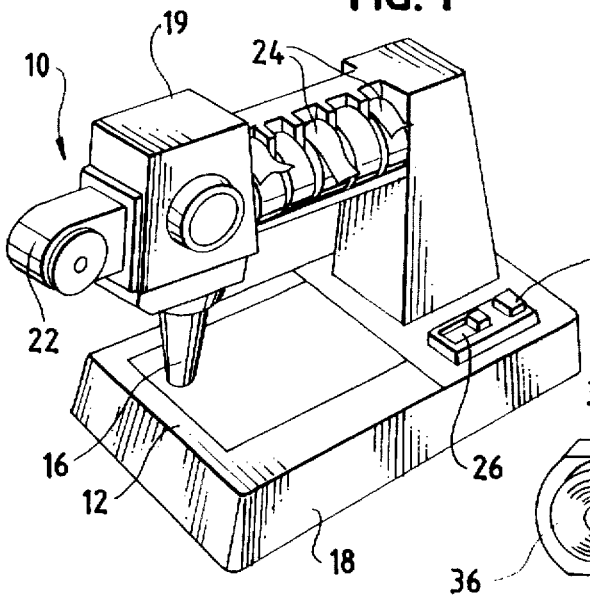
FIG. 1 illustrates a sewing machine-type of tool for ejecting funnel-shaped cups made of tissue paper onto an adhesive sheet.

Referring first to FIG. 1, there is the "sewing machine" embodiment 10 of a toy incorporating the present invention including a base 12 on which a sheet having exposed adhesive surfaces is placed and to which the funnel-shaped cups 14 (see FIG. 2) are directed from the nozzle 16. The sheet is placed on the base 12 that is supported by a frame 18. The tool illustrated in this embodiment is an electrically operated plunger tool 19 that functions to take a section of tissue paper from a roll (not shown) and push the paper through the tapered nozzle 16 to form the funnel-shaped cup 14 and place the bottom 20 of the cup onto the adhesive surface of a sheet (not shown) located on the base 12. The general construction of the nozzle arrangement is illustrated in conjunction with the description of the preferred embodiment shown in FIGS. 5–9. Located adjacent the plunger arrangement is a tape roll housing 22 which includes one of the selected colors or widths of tape 24.

Figure 2:
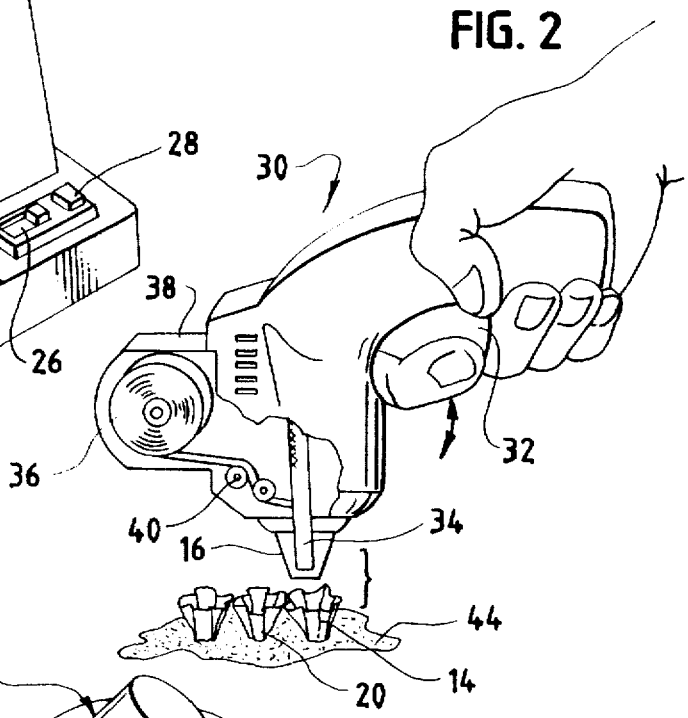
FIG. 2 is a second embodiment using a trigger-operated punch that separates a section of a tissue from a strip, forms it into a funnel shape, and places it on an adhesive sheet.
Figure 3:
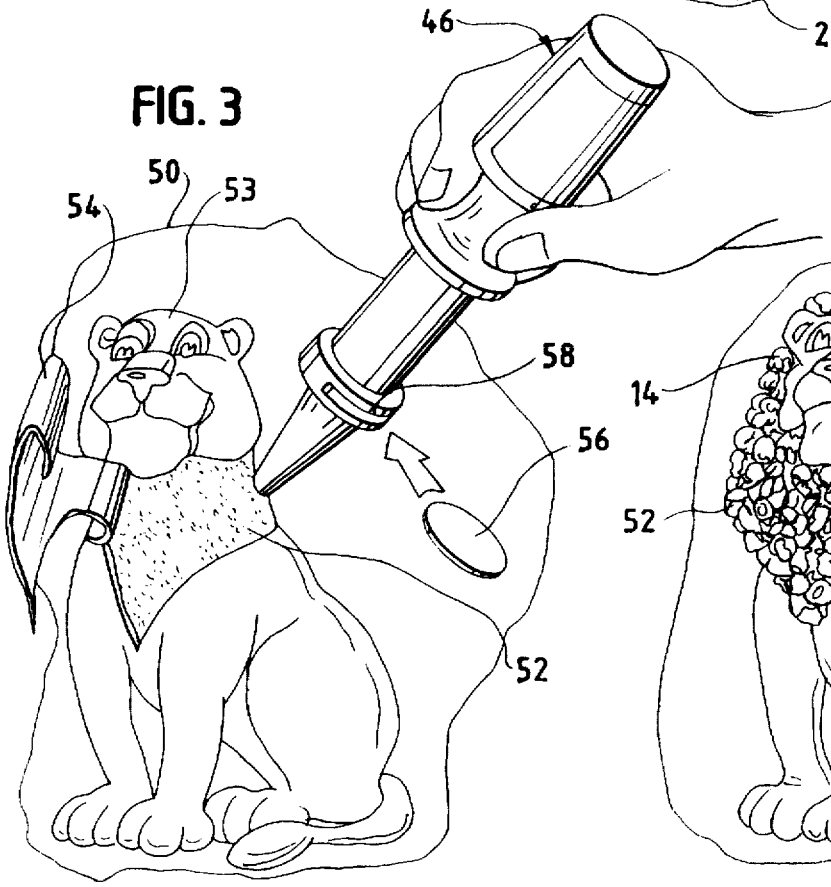
FIG. 3 shows the application of a cup-shaped arrangement onto an adhesive sheet by a manual operated tool.

It remains to note that the machine 10 is operated by an on/off switch 26 and when placed in the on position, the button control 28 is used to energize the plunger of the type as shown in FIG. 2.

Referring now to FIG. 2, there is a illustrated a gun-type tool 30 in which the operator pulls a trigger 32 to effectuate movement of the plunger 34 against a spring (not shown). In this embodiment, a tape roll 36 is located in the housing 38 of the tool and is disposed about rollers 40. When a first cup is formed and the plunger 34 withdrawn, a serrated end section of the roll 36 is automatically sequentially placed into position under the plunger 34 to be engaged thereby to remove a new section of the roll and form the funnel-shaped cup decoration 14. During the funnel shaping of the decoration 14, the plunger 34 forces the tissue section through the nozzle 16 into engagement with the adhesive surface of the sheet 44.

While a serrated roll of tissue has been referred to, the material used in this tool 20, as well as the aforementioned "sewing machine" version, is by way of example only. The tape roll can be made of other deformable material such as foil or acetate, etc., and the various tools can include a cam operated cutter, or the like, whereby a section of the roll can be severed therefrom before being acted upon by the plunger to form a funnel-shaped cup.

Figure 4:
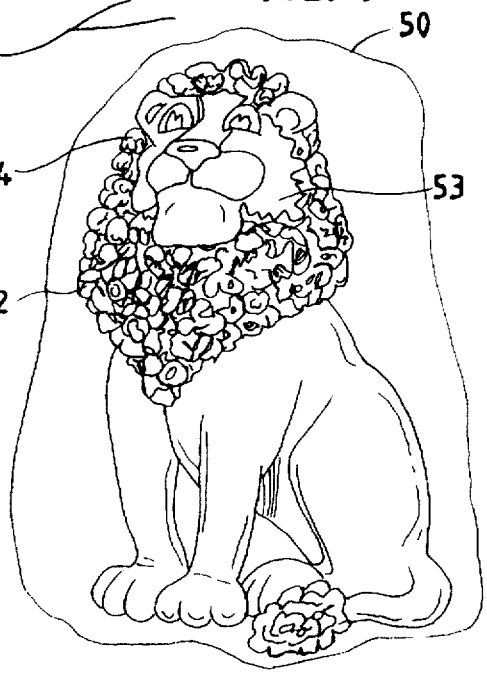
FIG. 4 shows a picture incorporating a plurality of cup-shaped members.

Referring now to the preferred embodiment in FIGS. 5–9, there is shown the manually operated plunger tool 46 being used to direct an application of a wrinkled funnel-shaped cup onto the two-ply sheet 50 in which the bottom ply 52 has an adhesive surface that has been exposed by removing the release sheet 54. The adhesive area 52 adjacent the lion's head 53 is where the cups 14 are located to form the three-dimensional ornamentation shown in FIG. 4. The funnel-shaped cup is formed by engaging the plunger shown in detail in FIGS. 5–9 which acts to engage a tissue disk 56 that has been placed in the opening 58 of the housing which places it in position to be contacted by the plunger 62 and formed into the funnel-shaped cup. While the disk is shown as being circular, it can be star-shaped, or any other desired shape suitable for use. The details of the tool are best seen by referring to FIGS. 5–9.

In FIG. 5, the pen-type plunger tool 46 is shown as consisting of an upper reciprocable handle 64 attached to which is the plunger 62 by the fasteners 66. The plunger 64 extends through the handle and lower body portion 68 into resting position adjacent an upper channel section 70 which has a tubular portion 72 to which the body portion 68 is shown as being crimped to essentially form it into a single unit. The spring 74 is located in the chamber 76 formed by the body 68 and the compression spring 74 biases the plunger 62 and handle 64 upwardly to the position shown in FIG. 5.

The lower body portion 78 of the tool includes a channel-shaped section 80 at its upper end that is connected by fasteners 82 to upper channel section 70 to form the opening 58 in which the tissue disk 56 is placed to be engaged by the plunger 62 upon downward movement of handle 64. The bottom part of the body portion 78 includes the tapered funnel-shaped nozzle 84. As shown by referring to FIG. 6, when the handle 64 is moved downwardly, the spring 74 is compressed, and the plunger 62 engages the tissue disk 56 to form it into the funnel-shaped cup 86 in the bottom of the nozzle 84. In this position, the tool is placed against the adhesive surface of the sheet 52. When the tool 46 is removed from the sheet 52, the cup 86 remains in the position shown in FIG. 8. When the handle is released, the plunger 62 and housing 64 again move upwardly to the position shown in FIG. 5. In FIG. 8, there is shown the tool 46 withdrawn from the funnel-shaped cup.

Referring now to FIG. 9, there is shown the exploded view of the various components of the manually operated tool 46.

While three embodiments have been illustrated and described, it is, of course, intended to cover by the appended claims all such modifications as fall within the true spirit and scope of the invention. For example, while a funnel-shaped nozzle has been illustrated, other shaped nozzles can be employed to provide other cup-shaped configurations.

What is claimed is:

1. A device for forming funnel shaped decorative cups adapted to be connected to an adhearable base surface comprising an elongated housing assembly having at one end at funnel shaped outlet passage and its other end a reciprocable handle, a plunger disposed within said housing assembly and secured to said reciprocable handle, means for biasing the handle and plunger to a raised position, said housing defining an opening under said plunger when in the raised position for receiving an insert disposed below said plunger to be formed into a cup where by when the handle and plunger are lowered against said biasing means by the actuation of said handle the plunger extends through the outlet passage and engages the insert located in said opening to form the insert into a funnel shaped cup and move it out of said outlet passage where it can be adhered to a base surface for ornamental purposes.

2. A device is set forth in claim 1 in which the elongated housing assembly comprises a central generally tubular portion and the handle is hollow and fits over said tubular portion and the means for biasing said handle and plunger to its raised position includes a spring located in said tubular portion and engages with said handle plunger assembly whereby when the handle is moved against the spring it moves over said tubular portion.

3. A device is set forth in claim 2 in which the housing outlet passage is located in a lower section secured to the tubular portion and the opening for receiving the insert is located between said tubular portion and lower section.

4. A device is set forth in claim 2 in which the handle defines an annular recess where by the handle can be readily manipulated to eject a funnel shaped cup from said outlet passage.

* * * * *